US007192128B1

(12) United States Patent
Hattori et al.

(10) Patent No.: US 7,192,128 B1
(45) Date of Patent: Mar. 20, 2007

(54) INK CARTRIDGES

(75) Inventors: Shingo Hattori, Tsushima (JP); Yoshinori Yokoe, Inuyama (JP); Toyonori Sasaki, Anjo (JP); Motohiro Momozaki, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/536,671

(22) Filed: Sep. 29, 2006

Related U.S. Application Data

(60) Provisional application No. 60/826,254, filed on Sep. 20, 2006.

(30) Foreign Application Priority Data

Mar. 28, 2006 (JP) ..... 2006-088204

(51) Int. Cl.
*B41J 2/175* (2006.01)
*B41J 2/195* (2006.01)

(52) U.S. Cl. ..... 347/86; 347/7

(58) Field of Classification Search ..... 347/7, 347/84–86; 73/290 R, 291–334; 137/558
See application file for complete search history.

(56) References Cited

U.S. PATENT DOCUMENTS 5,526,026 A * 6/1996 Bowers ..... 347/6
5,842,800 A * 12/1998 Bailey et al. ..... 400/703
6,796,627 B2 9/2004 Kimura et al.
2005/0068389 A1 3/2005 Katayama et al.

FOREIGN PATENT DOCUMENTS

GB 2 245 973 A * 1/1992
JP 60220824 A * 11/1985
JP 8281966 A 10/1996
JP 7314716 A 12/1996
JP 200434406 A 2/2004

* cited by examiner

*Primary Examiner*—Stephen Meier
*Assistant Examiner*—Geoffrey S. Mruk
(74) *Attorney, Agent, or Firm*—Baker Botts, L.L.P.

(57) ABSTRACT

An ink cartridge includes a support member, and a rotatable member connected to the support member. The rotatable member includes a pivot portion formed at a point of connection between the support member and the rotatable member, and a signal blocking portion. The signal blocking portion is disposed within an inner space of a translucent portion. The rotatable member also includes a float portion disposed within an ink chamber. The float portion is positioned between the signal blocking portion and the pivot portion, and the float portion is configured to move between a first position and a second position based at least on an amount of ink disposed within the ink chamber. Specifically, as the ink within the ink chamber is dispensed from the interior of the ink chamber to the exterior of the ink chamber a surface of the ink within the ink chamber moves in a first predetermined direction, and when the float portion moves from the first position to the second position each of the float portion and the signal blocking portion moves about the pivot in a second predetermined direction which is slanted with respect to the first predetermined direction.

4 Claims, 6 Drawing Sheets

INK CARTRIDGES

CROSS-REFERENCE TO RELATED APPLICATIONS

The present application claims priority from Japanese Patent Application No. JP-2006-088204, which was filed on Mar. 28, 2006, and U.S. Provisional Patent Application No. 60/826,254, which was filed on Sep. 20, 2006, the disclosures of which are incorporated herein by reference in their entirety.

BACKGROUND OF THE INVENTION

1. Field of the Invention

The present invention relates generally to ink cartridges. In particular, the present invention directed towards ink cartridges which may be used in combination with ink jet printers 2. Description of Related Art Ink cartridges which are configured to be used in combination with ink jet printers are known in the art. In such known ink cartridges, it is possible to detect when the amount of ink in the ink cartridge is relatively low. For example, one known ink cartridge comprises a shutter mechanism which functions as a light-blocking portion, and a float on both edges of a level which is supported in the central portion of the ink reservoir element, such that it rotates about a support in the extender direction at the bottom of the ink reservoir element. Specifically, when there is a relatively large amount of ink in the ink reservoir element, the level will rotate due to an upwards movement of the float caused by buoyancy, thereby positioning the shutter near the bottom of the concave portion of the ink reservoir element, such that the shutter blocks the light that is emitted from a light emitting portion of an optical sensor. When the ink is removed from the ink reservoir element, the float drops and the level rotates, resulting in the shutter being positioned near the top portion of the concave portion, thereby stopping the blockage of light emitted from the light emitting portion. At this time, the light receiving portion of the optical sensor receives the light, and detects that the ink reservoir element is empty.

Nevertheless, in this known ink cartridge, a relatively large shutter mechanism is employed, and the shutter and the float are positioned on both edges of the level which is supported by the support member, which increases the size of the ink cartridge needed to house the shutter mechanism.

SUMMARY OF THE INVENTION

Therefore, a need has arisen for ink cartridges which overcome these and other problems associated with the related art. A technical advantage of the present invention is that the ink cartridge may detect when the ink reservoir element is substantially empty without increasing the size of the ink cartridge.

According to embodiment of the present invention, an ink cartridge comprises an ink chamber comprising a first wall having a first end and a second end opposite the first end, and a second wall which is substantially perpendicular to the second wall and is connected to the second end of the first wall. The ink cartridge also comprises a translucent portion positioned at the first wall. The translucent portion is configured to be in fluid communication with the ink chamber, and the translucent portion has an inner space formed therein. The ink cartridge also comprises an ink supply portion having an opening formed therethrough, and the ink supply portion is positioned at the first wall adjacent to the second end of the wall, and the translucent portion is positioned between the first end of the first wall and the ink supply portion. Moreover, the ink cartridge comprises a support member which may be connected to the second wall, and a rotatable member connected to the support member. The rotatable member comprises a pivot portion formed at a point of connection between the support member and the rotatable member, and a signal blocking portion. The signal blocking portion is disposed within the inner space of the translucent portion. The rotatable member also comprises a float portion disposed within the ink chamber. The float portion is positioned between the signal blocking portion and the pivot portion, the float portion is positioned closer to the second wall than the signal blocking portion, and the float portion is configured to move between a first position and a second position based at least on an amount of ink disposed within the ink chamber. For example, in an embodiment of the present invention, as the ink within the ink chamber is dispensed from the interior of the ink chamber to the exterior of the ink chamber a surface of the ink within the ink chamber moves in a first predetermined direction, and when the float portion moves from the first position to the second position each of the float portion and the signal blocking portion moves about the pivot in a second predetermined direction which is slanted with respect to the first predetermined direction.

BRIEF DESCRIPTION OF THE DRAWINGS

For a more complete understanding of the present invention, the needs satisfied thereby, and the features and technical advantages thereof, reference now is made to the following descriptions taken in connection with the accompanying drawings.

FIG. 5(*b*) is a schematic diagram of a known rotating member.

DETAILED DESCRIPTION OF EMBODIMENTS

Embodiments of the present invention and their features and technical advantages may be understood by referring to FIGS. 1–6, like numerals being used for like corresponding portions in the various drawings.

Figure 1:
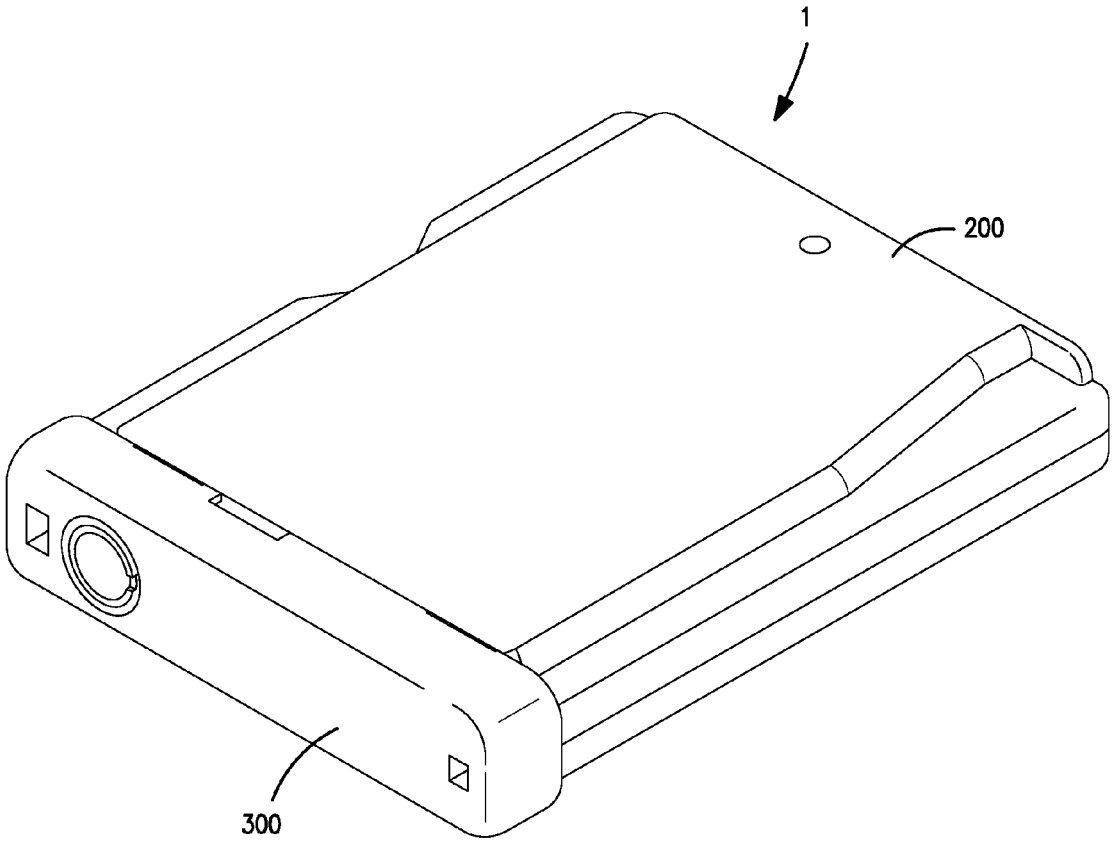
FIG. 1 is a perspective view of an ink cartridge, according to an embodiment of the present invention.
Figure 2:
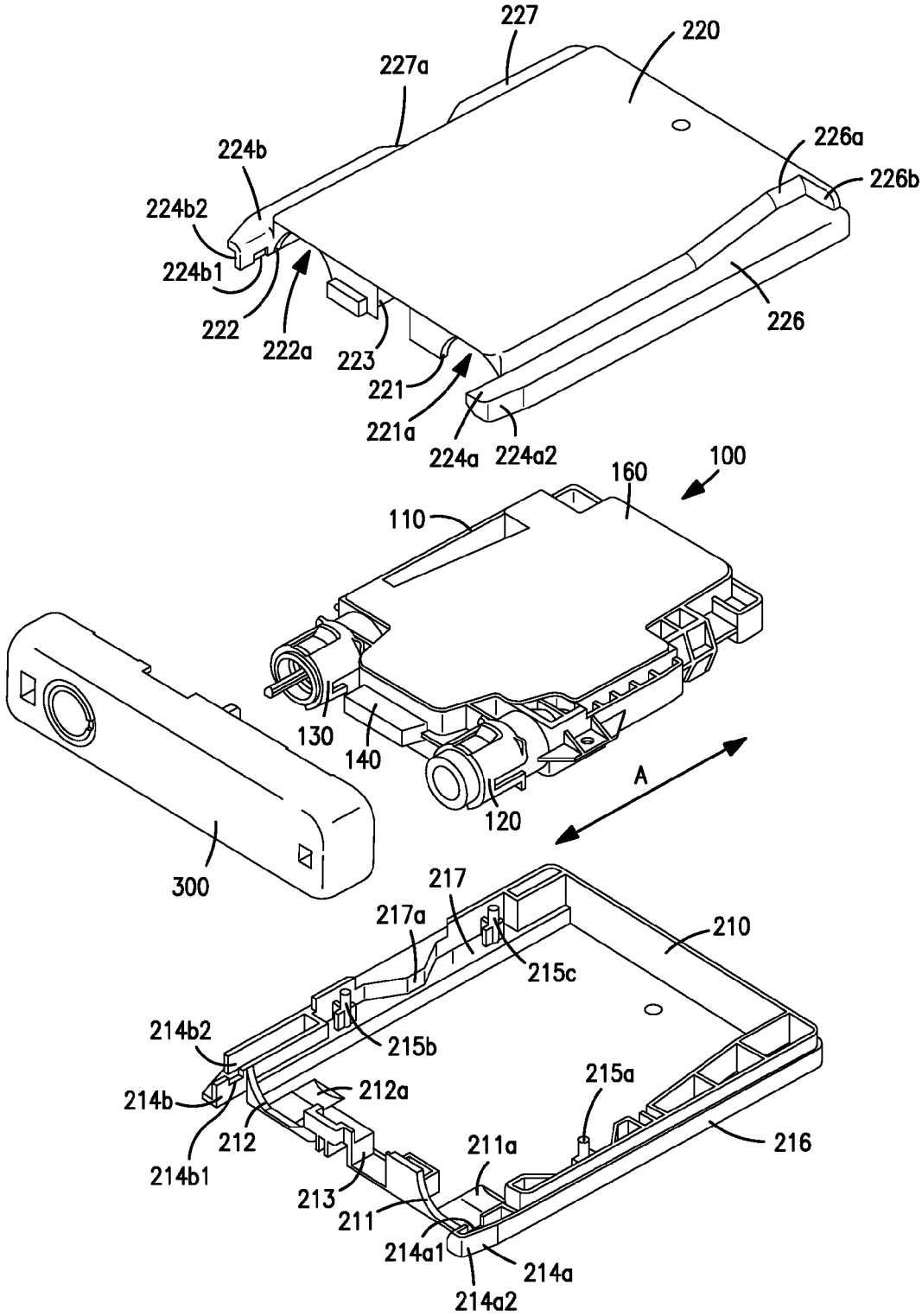
FIG. 2 is an expanded, perspective view of the ink cartridge of FIG. 1, according to an embodiment of the present invention.

Referring to FIGS. 1 and 2 an ink cartridge 1 according to the embodiment of the present invention is depicted. Ink cartridge 1 may comprise an ink reservoir element 100 which is configured to store ink, e.g., a light-permeable ink, an outer case 200 which covers the entirety of the ink reservoir element 100, and a protector 300 which is attached to outer case 200 and protects ink reservoir element 100 when transporting ink cartridge 1. In this embodiment of the present invention, ink reservoir element 100, outer case 200, and protector 300 may comprise a resin material, such as nylon, polyethylene, polypropylene, or the like.

Outer case 200 may comprise a first case member 210 and a second case member 220, which sandwich ink reservoir element 100 from the top and the bottom. First case member 210 may cover the lower side of ink reservoir element 100, and second case member 220 may cover the upper side of the ink reservoir element 100. First and second case members 210 and 220 may comprise a resin material, and may be manufactured using an injection molding.

First case member 210 may have a pair of case cut-out portions 211 and 212 formed therethrough which expose ink supply portion 120 and air intake portion 130, respectively, to the outside of outer case 200. Case cut-out portions 211 and 212 each may have a half-circle shape, and case cut-out portion 211 may be a cut-out corresponding to ink supply portion 120 and case cut-out portion 212 may be a cut-out corresponding to air intake portion 130. Moreover, a case cut-out portion 213 may be formed between case cut-out portion 211 and the case cut-out portion 212, and may be formed in a rectangular shape. Case cut-out portion 213 may be a cut-out for insertion of optical sensor 1014 to a position in which optical sensor 1014 sandwiches translucent portion 140. A contact groove 211*a* may be formed on the inner side surface that is connected with case cut-out portion 211 of first case member 210, and contact groove 211*a* may contact ink supply portion 120. Similarly, a contact groove 212*a* may be formed on the inner side surface that is connected with case cut-out portion 212 of first case member 210, and contact groove 212*a* may contact air intake portion 130. By using contact grooves 211*a* and 212*a*, first case member 210 readily may be aligned.

First case member 210 also may comprise two case protrusion portions 214*a* and 214*b* that protrude in the protector 300 direction from the surface where case cut-out portions 211–213 are formed. Case protrusion portions 214*a* and 214*b* may be formed on both sides of first case member 210, such that they sandwich case cut-out portions 211–213. Case protrusion portion 214*a* may have a sloped surface 214*a*2 that is sloped in the case cut-out portions 211–213 direction towards the edge from the portion that is connected to the side wall of first case member 210. When installing ink cartridge 1 into printer 1000, the installation may be made with case protrusion portion 214*a* on the lower side. Therefore, when installing ink cartridge 1, when sloped surface 214*a*2 is in contact with the lower portion of printer 1000, ink cartridge 1 may be smoothly introduced into a predetermined attachment position.

Further, a case protrusion cut-out portion 214*b*1 may be formed in case protrusion portion 214*b* on the inner side surface which is the case cut-out portion 211–213 side, and case protrusion cut-out portion 214*b*1 may be formed in a rectangular shape. A case mating groove 214*b*2, which may mate with the mating rod 1016*b*1 when ink cartridge 1 is installed in printer 1000, may be formed in case protrusion portion 214*b*.

Moreover, a rod component 215*a* may be formed on first case member 210 to align ink reservoir element 100, which protrudes in the second case member 220 direction near the side wall of the first case component 210 on the ink supply portion 120 side, and a pair of rod components 215*b* and 215*c* may be formed to align ink reservoir element 100, which protrude to the second case member 220 side near the side wall of the first case component 210 on the air intake portion 130 side. Because alignment of ink reservoir element 100 may be performed at the three locations associated with rod components 215*a*–215*c*, it may be possible to prevent incorrect attachment of ink reservoir element 100.

Within second case member 220, as in case member 210, not only may there be three case cut-out portions 221–223, there may be a contact groove 221*a* that is connected to case cut-out portion 221, and a contact groove 222*a* that is connected to the case cut-out portion 222. Moreover, on both sides of case cut-out portions 221–223, there may be case protrusion portions 224*a* and 224*b*, and case protrusion portion 224*a* may have a sloped surface 224*a*2 which is sloped in the case cut-out portion 221–223 direction towards the edge from the portion that is connected to the side surface of second case member 220. Further, in case protrusion portion 224*b*, there may be a case protrusion cut-out portion 224*b*1 with the same construction as case protrusion cut-out portion 214*b*1, and a case mating groove 224*b*2 formed that extends over the side surface of second case member 220 from the edge of case protrusion portion 224*b*. Within second case member 220, there may be a mating hole portion (not shown) having a hole for mating rod components 215*a*–215*c*.

First and second case members 210 and 220 may have a concave shape with both side surfaces in the direction that intersects the longitudinal direction A, and there may be a step formed with respect to the surface of first and second case members 210 and 220. In this stepped portion, first and second case members 210 and 220 may be attached, and ink reservoir element 110 may be fixed with respect to external case 200. The stepped portion on the ink supply portion 120 side may be the first case attachment portion 216 and 226, and the stepped portion on the air intake portion 130 side may be the second case attachment portion 217 and 227.

First case attachment portion 226 may be connected to the same planar surface as case protrusion portion 224*a*, a concave portion 226*a* may have a concave shape in the inner direction of second case component 220 on the opposite side to case protrusion portion 224*a*, and a mating portion 226*b* may mate with a engaging member 1017 when ink cartridge 1 is installed in printer 1000. Concave portion 226*a* is a region that allows movement of engaging member 1017 when the engaging member 1017 moves. Case attachment portion 227 may comprise a locking portion 227*a* which has a concave shape at a central position in the longitudinal direction of second case component 220, and locking portion 227*a* may be a portion which locks ink cartridge 1 when ink cartridge 1 is installed in printer 1000.

Although not discussed in detail, within first case component 210, there also may be a concave portion 216*a*, a mating portion 226*b*, and a locking portion 217*a* having substantially the same shape as concave portion 226*a*, mating portion 226*b*, and locking portion 227*a*, respectively, of second case member 220.

Figure 3:
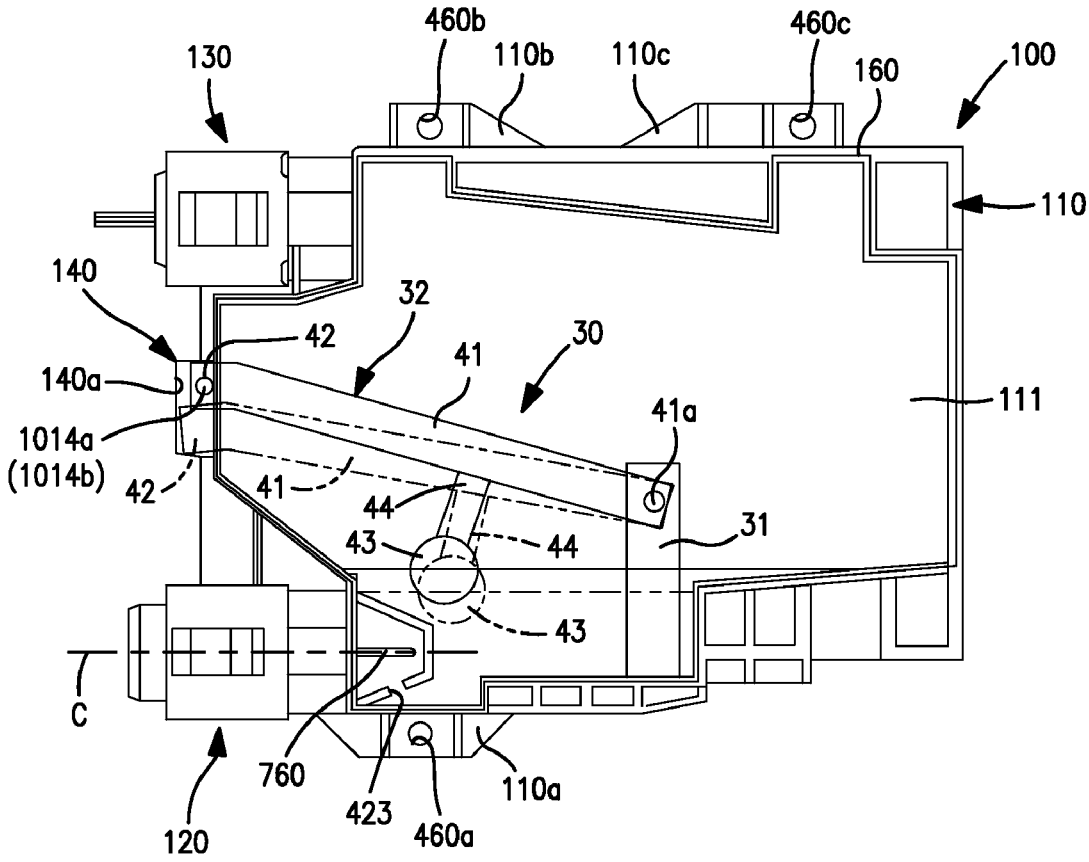
FIG. 3 is a side view of an ink reservoir element of the ink cartridge of FIG. 2, according to an embodiment of the present invention.
Figure 4:
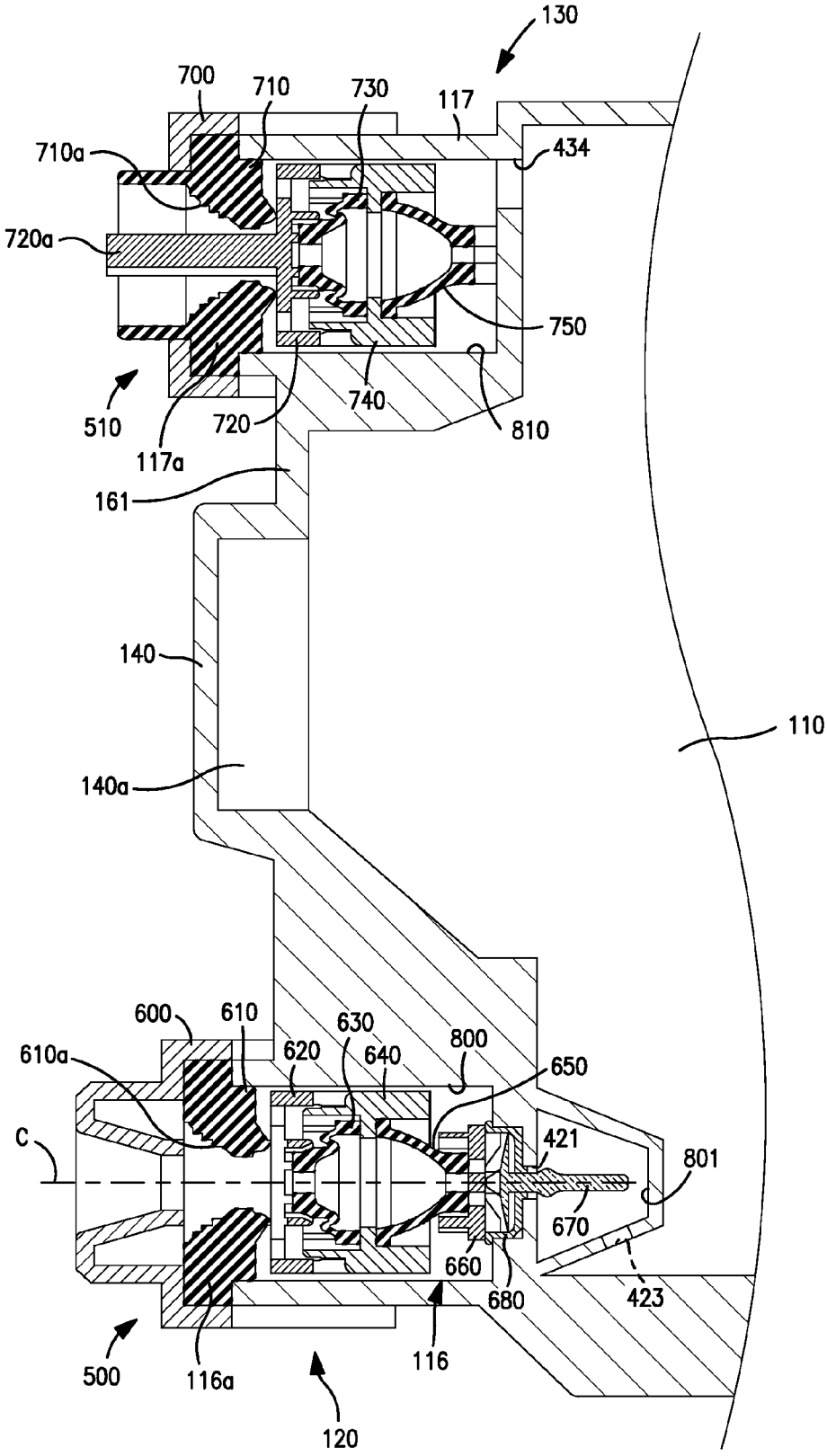
FIG. 4 is a partial, expanded diagram of the ink reservoir element of FIG. 3, according to an embodiment of the present invention.
Figure 5A:
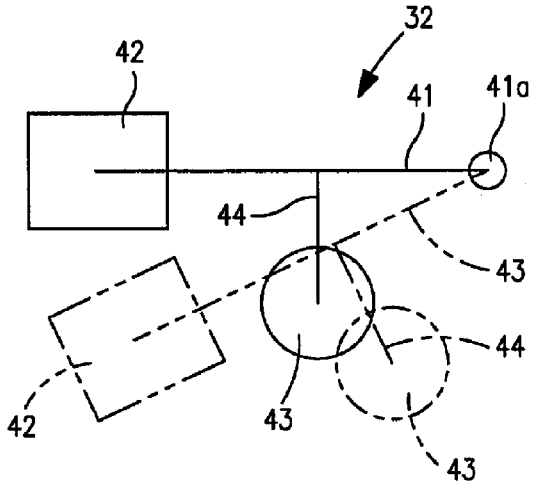
FIG. 5(*a*) is a schematic diagram of an rotating member of the ink reservoir element of FIG. 3, according to an embodiment of the present invention.
Figure 5B:
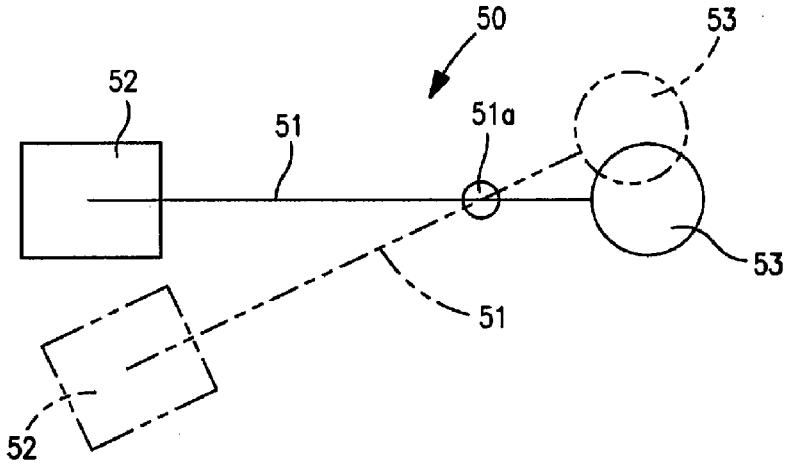
FIGURE 5(b) PRIOR ART

Referring to FIGS. 3–5, ink reservoir 100 now is described. When ink cartridge 1 is installed in printer 1000, ink supply portion 120, air intake portion 130, and translucent portion 140 may be positioned on the side surface, in which ink supply portion 120 is positioned on the lower side, and air intake portion 130 is positioned on the top side. Moreover, in FIG. 3, the outer boundaries of side plate 160 are shown using a bold line, and the positions of light emitting portion 1014*a* and light receiving portion 1014*b* when ink cartridge 1 is installed in printer 1000 are shown using a dashed line.

In an embodiment of the present invention, ink reservoir 100 may comprise an ink chamber 111 and a communication path 116 within rectangular shaped case 110. On the lower surface of case 110, a single attachment portion 110*a* which extends downwards may be provided, and on the upper surface of case 110, a pair of attachment portions 110*b* and 110*c* which extend upwards may be provided. Attachment portions 110*a*–110*c* may have through-holes 460*a*–460*c* formed therethrough, which mate with rod components 512*a*–512*c*, respectively, of first cast component 210. Further, by mating through-holes 460*a*–460*c* with rod components 512*a*–512*c*, respectively, it is possible to align ink reservoir 100 within external case 200.

An ink chamber 111 may be provided in substantially the entire space within case 110 except for communication path 116, an air intake path 117, and a translucent portion 140. Ink may be stored within ink chamber 111. Such ink may have light-permeability properties, and may be supplied to printer 1000 from communication path 116. Specifically, communication path 116 may be in fluid communication with ink chamber 111 and ink supply portion 120, and may be configured to dispense ink from an interior of ink chamber 111 to an exterior of ink chamber 111 via an opening formed in ink supply portion 120. Communication path 116 may be substantially perpendicular to the wall on which ink supply portion 120, air intake portion 130, and translucent portion 140 are formed, and communication path 116 may have a center line C.

In an embodiment of the present invention, translucent portion 140 may protrude leftwards in the central portion in the vertical direction of side wall 161 on the left side of ink chamber 111. Inside translucent portion 140, an inner space 140*a* may be formed, which may communicate with ink chamber 111. Translucent portion 140 may be positioned between light emitting portion 1014*a* and light receiving portion 1014*b* of optical sensor 1014 when ink cartridge 1 is installed in printer 1000. Light emitting portion 1014*a* and light receiving portion 1014*b* may be positioned on the front side and the back side of FIG. 3. Translucent portion 140 may have light-permeable properties, e.g., may be translucent or transparent, and when the light emitted from light emitting portion 1014*a* is not blocked by light blocking portion 42, the light is received by light receiving portion 1014*b*.

A shutter mechanism 30 may be provided inside ink chamber 111. Shutter mechanism 30 may comprise a support member 31 and a rotating member 32. Rotating member 32 may comprise a resin material having a specific gravity which is less that the specific gravity of the ink within ink chamber 111, and the mass per unit volume of the resin material may be less than the mass per unit volume of the ink within ink chamber 111. Support member 31 may extend perpendicularly from the bottom surface of ink chamber 111, and may support rotating member 32, such that support rotating member 32 may rotate. Rotating member 32 may comprise an arm portion 41, a light blocking portion 42, a float portion 43, and a branched arm portion 44, and float portion 42 may be positioned closer to the bottom surface of ink chamber 111 than light blocking portion 42 is positioned to the bottom surface of ink cartridge 111. Arm portion 41 may be rotatably supported at fulcrum 41*a*, e.g., a pivot portion, in a support portion provided in support member 31. Fulcrum 41*a* may be formed at the right end of arm portion 41. Arm portion 41 may extend from fulcrum 41*a* towards the left upper side of FIG. 3 to translucent portion 140. Light blocking portion 42 may be connected to the left end of arm portion 41, and may be positioned within inner space 140*a* of translucent portion 140. Further, light blocking portion 42 may be configured to block the light that is emitted from light emitting portion 1014*a* of the optical sensor 1014, and that permeates translucent portion 140 when positioned within inner space 140*a*. In addition, branched arm portion 44 branches and protrudes from the portion of arm portion 41 which is located between fulcrum 41*a* and light blocking portion 42, and branched arm portion may protrude towards the bottom side of ink chamber 111. Float portion 43 may be positioned on the end of branched arm portion 44, and the volume of float portion 43 may be greater than, e.g., substantially greater than, the other portions of rotating member 32. Float portion 43 may have a cavity inside in which air is packed, and the mass per unit volume including the air inside may be less than the mass per unit volume of the other portions of rotating member 32. Moreover, in an embodiment of the present invention, float portion 43 is unaligned with center line C of communication path 116 regardless of the position of float 43 within ink chamber 111.

When there is a sufficient amount of ink within ink chamber 111, because the buoyancy generated on rotating member 32 is greater than the gravity generated on rotating member 32, a clockwise moment about fulcrum 41*a* in FIG. 3 acts on rotating member 32, and arm portion 41 rotates in a clockwise direction about fulcrum 41*a* along with light blocking portion 42. However, at this time, the top edge of light blocking portion 42 is in contact with the upper surface of translucent portion 140, and arm portion 41 is prevented from rotating in the clockwise direction. Specifically, when the amount of ink within ink chamber 111 is greater than a predetermined amount of ink, light blocking portion 42 is in contact with the upper surface of the translucent portion 140. At this time, the light emitted from light emitting portion 1014*a* is blocked by light blocking portion 42. In this way, because the rotation of arm portion 41 is prevented by the upper surface of translucent portion 140, when there is more than the predetermined amount of ink within ink chamber 111, light blocking portion 42 blocks the light emitted from light emitting portion 1014*a*.

As the amount of ink within ink chamber 111 decreases, light blocking portion 42 and arm portion 41 gradually are exposed from the ink surface, and the buoyancy generated on the rotating member 42 decreases. However, the volume of float 43 within the ink is greater than the volume of the exposed portion, and float portion 43 has a smaller mass per unit volume than the exposed portion. Therefore, the buoyancy generated on rotating member 32 still is greater than the gravity generated on rotating member 32, such that the position of rotating member 32 does not change. As the amount of ink further decreases, one portion of the float portion 43 may be exposed from the ink surface, and the buoyancy generated on rotating member 32 becomes substantially equal to the gravity generated on rotating member. After this, float portion 43 moves downwards in accordance with the drop of the ink level as the ink decreases. As a result, rotating member 32 rotates in a counterclockwise direction, and light blocking portion 42 moves downwards in FIG. 3. When arm portion 41 has rotated by a predetermined amount in a counterclockwise direction, light blocking portion 42 no longer blocks light emitted from light emitting portion 1014*a*, and the light is received by light receiving portion 1014*b*. Optical sensor 1014 then detects that the amount of ink within the ink chamber 111 is insufficient, and a warning to change the ink cartridge may be generated and displayed.

As the amount of ink within ink chamber 111 falls further, arm portion 41 further rotates in the counterclockwise direction. However, as arm portion 41 rotates in the counterclockwise direction, the lower edge of light blocking portion 42 contacts the lower surface of translucent portion 140 that bounds bottom of inner space 140*a*. As a result, any further rotation of arm portion 41 in the counterclockwise direction is prevented.

Referring to FIG. 5(*b*), in a known rotating member 50, an arm portion 51 is supported at its middle portion, such that it rotates about the fulcrum 51*a* at the middle portion. A blocking portion 52 and a float portion 53 are located on opposite sides of fulcrum 51*a*. Some of the differences between rotating member 32 of embodiments of the present invention and known rotating member 50 now will be discussed with respect to FIGS. 5(*a*) and 5(*b*). In order to make the movement distance of light blocking portions 42 and 52 the same, if the distance between fulcrum 41*a* and light blocking portion 42 is the same as the distance between fulcrum 51*a* and light blocking portion 52, then instead of setting float portion 53 on the opposite side of fulcrum 51*a* from light blocking portion as shown in FIG. 5(*b*), when setting float portion 43 to be positioned between fulcrum 41*a* and light blocking portion 42 as shown in FIG. 5(*a*), it is possible to make arm portion 41 to be shorter than arm portion 51 because it is not necessary to extend arm portion 41 to the opposite side of fulcrum 41*a* from light blocking portion 42. As a result, it is possible to minimize the size of rotating member 32. Further, in rotating member 32, because float portion 43 is positioned on the end of branched arm portion 44 which branches from arm portion 41, it is possible to detect that there is little ink remaining when the ink level within ink chamber 111 is at a lower position than the known case shown in FIG. 5(*b*).

Referring again to FIG. 4, communication path 116 may be formed below translucent portion 140 on side wall 161, and an air intake path 117 may be provided above translucent portion 140. In the state shown in FIG. 4, communication path 116 and air intake path 117 extend in the horizontal direction, a valve mechanism 500 may be positioned within inside the communication path 116, which may be configured to selectively open and close an ink outlet 116*a* of communication path 116, and an air intake mechanism 510 may be positioned within air intake path 117, which may be configured to selectively open and close an air intake inlet 117*a* of air intake path 117. Moreover, ink supply portion 120 may be in fluid communication with communication path 116 and may comprise valve mechanism 500, and air intake portion 130 may be in communication with air intake path 117 and may comprise air intake mechanism 510.

Communication path 116 may comprise a valve storage portion 800 and an ink supply chamber 801. Valve storage portion 800 stores a portion of valve mechanism 500. Valve storage portion 800 may communicate with ink supply chamber 801 via connection hole 421. Ink supply chamber 801 may communicate with ink chamber 111 via connection hole 423. The path from ink supply chamber 801 to ink outlet 116*a* via connection hole 421 and valve storage portion 800 may extend substantially in the horizontal direction. In communication path 116, the ink within ink chamber 111 flows into ink supply chamber 801 via connection hole 423, and further, it flows into valve storage portion 800 via connection hole 421.

Referring to FIG. 4, valve mechanism 500 may comprise a supply cap 600, a supply joint 610, a supply valve 620, a first supply spring 630, a supply slider 640, a second supply spring 650, a valve seat 660, a check valve 670, and a cover 680. Supply cap 600 may be attached adjacent to ink outlet 116*a* of communication path 116. Supply joint 610 may comprise an elastic resin material, such as rubber. A through-hole 610*a* which extends in the horizontal direction may be formed in the central portion of supply joint 610, and an ink extraction pipe 1015 of printer 1000 may be inserted into through-hole 610*a*. Supply joint 610 covers the surrounding area of ink outlet 116*a* of communication path 116. When ink cartridge 1 is not installed in printer 1000, supply valve 620 may be pressed towards the left-hand side of FIG. 4 by a first supply spring 630, and the left side wall of supply valve 620 may contact the right side edge portion of supply joint 610, such that through-hole 610*a* may be closed. In contrast, when ink cartridge 1 is installed in printer 1000, supply joint 610 moves to the right side of FIG. 4 because it is pressed by ink extraction pipe 1015, and because a spacing is built up between supply joint 610 and supply valve 620, communication path 116 and ink extraction pipe 1015 communicate with each other, making it possible to supply ink to printer 1000. In this way, it is possible to perform opening and closing of ink outlet 116*a* of communication path 116.

First supply spring 630 and second supply spring 650 may sandwich supply slider 640. Supply slider 640 may operate in the movement direction, e.g., the right/left direction of FIG. 4, of supply valve 620, and it may cover the right side of supply valve 620. Second supply spring 650 may have substantially the same shape and may comprise substantially the same material as first supply spring 630, and may be stored within supply slider 640. Second supply spring 650 presses supply slider 640 to the left side. Valve seat 660 may contact second supply spring 650 and may support check valve 670. Check valve 670 may be positioned adjacent to connection hole 421 and may prevent back-flow of the ink in connection hole 421. Cover 680 and valve seat 660 may cover check valve 670.

Air intake path 117 extends in the horizontal direction, and may comprise an air intake mechanism storage portion 810 which stores a portion of air intake mechanism 510, and a connection hole 434 which provides communication between air intake mechanism storage portion 810 and ink chamber 111.

Air intake mechanism 510 may comprise an air cap 700, an air joint 710, an air valve 720, a first air spring 730, an air slider 740, and a second air spring 750. Air cap 700 may be connected to an air intake inlet 117*a* of air intake path 117. Air joint 710 may comprise an elastic resin material, such as rubber. A through-hole 710*a* which extends in the horizontal direction may be formed in the central portion of air joint 710. Air joint 710 covers the surrounding area of air intake inlet 117*a*. When ink cartridge 1 is not installed in printer 1000, supply valve 720 may be pressed to the left-hand direction of FIG. 4 by first supply spring 730. The left side wall of supply valve 720 may contact the right edge portion of supply joint 710, such that through-hole 710*a* may be closed. In contrast, when ink cartridge 1 is installed in printer 1000, protrusion portion 720*a* which protrudes to the outer side of ink intake inlet 117*a* from the left edge of air valve 720 moves to the right side of FIG. 4 because it is pressed by contact with the attachment surface 1013, and because a spacing is created between air joint 710 and air valve 720, air intake path 117 and air intake portion 1013*b* communicate with each other, enabling the intake of air. In this way, it is possible to perform opening and closing of air intake inlet 117*a* of air intake path 117.

First air spring 730 and second air spring 750 may sandwich air slider 740. Air slider 740 covers the right side of air valve 720. Air slider 740 also may operate in the movement direction, e.g., the right/left direction of FIG. 4, of air valve 720 which is pressed by contact with the wall surface of attachment surface 1013. Second air spring 750 may have substantially the same shape and may comprise substantially the same material as first air spring 730. Second air spring 750 may be stored within air slider 740, and it may press air slider 740 to the left side.

Figure 6A:
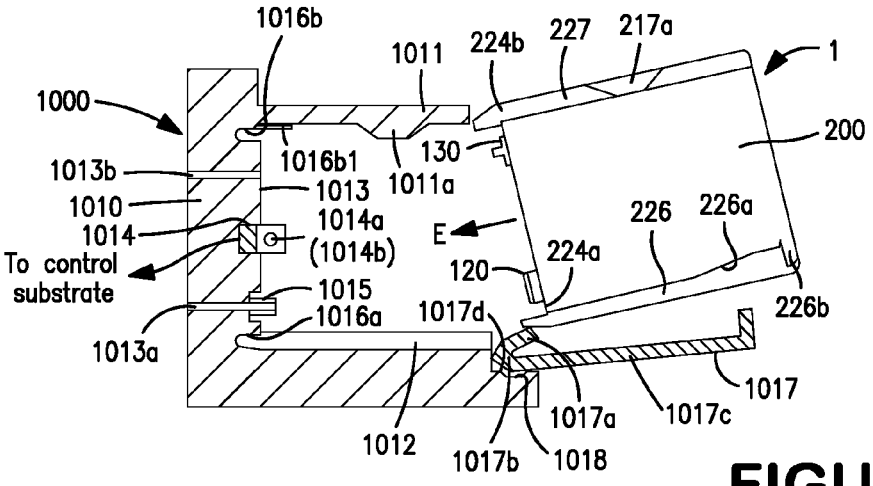
FIGS. 6(*a*)–6(*c*) are diagrams showing how to install the ink cartridge of FIG. 1 into a printer, according to an embodiment of the present invention.
Figure 6B:
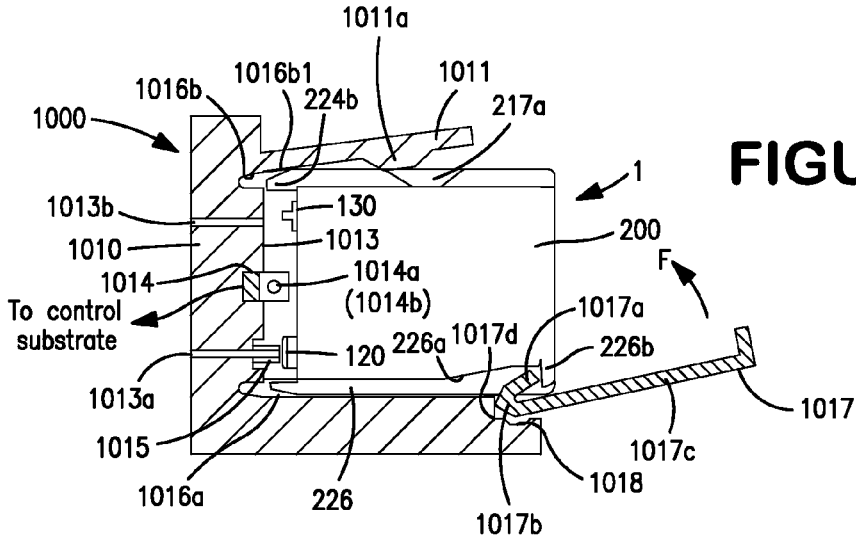
Figure 6C:
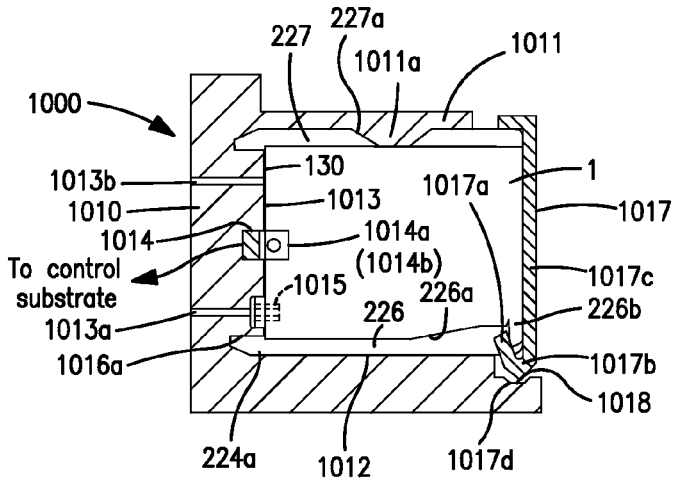

As shown in FIG. 6(*a*), an installation portion 1010 of printer 1000 may comprise a locking rod 1011 that protrudes in the right-side direction in FIG. 6 from the attachment portion 1010. Locking rod 1011 locks locking portions 217*a* and 227*b* of external case 200. Installation portion 1010 also may comprise a support portion 1012 which supports first case attachment portions 216 and 226 of external case 200 from below and has a concave shape corresponding to the shape of first attachment portions 216 and 226. Moreover, a convex portion 1011*a* may be formed on locking rod 1011, which protrudes toward support portion 1012 and has the same shape as locking portions 217*a* and 227*a*.

Optical sensor 1014, e.g., a U-shaped optical sensor, may be provided on installation surface 1013 of installation portion 1010. One end of optical sensor 1014 may be light emitting portion 1014*a* which emits light, and the other end of optical sensor 1014 may be light receiving portion 1014*b* which receives the light. Light emitting portion 1014*a* and light receiving portion 1014*b* protrude from installation surface 1013, such that they may be inserted into the through-holes formed by case cut-out portions 213 and 223 and translucent portion 140. When the light emitted from light emitting portion 1014*a* is received by light receiving portion 1014*b*, optical sensor 1014 outputs a signal to the control substrate (not shown) in printer 1000, and when the light emitted from light emitting portion 1014*a* is blocked and light receiving portion 1014*b* does not receive the light, no signal is output to the control substrate, and it is possible to print.

Moreover, ink extraction pipe 1015 protrudes from installation surface 1013 on the side corresponding to ink supply portion 120, and installation surface 1013 on the side corresponding to the air intake portion 130 may have a planar surface. Ink path 1013*a* may be connected to ink extraction pipe 1015, and ink may be supplied to printer 1000 via ink path 1013*a*. An air intake path 1013*b* may be formed on installation surface 1013 on the air intake portion 130 side, and air may be drawn into ink chamber 111 via air intake path 1013*b*.

Case protrusion portions 214*a* and 224*a* case protrusion portions 214*b* and 224*b* of the external case 200 may be inserted into both sides of installation surface 1013, and concave portions 1016*a* and 1016*b* may be formed corresponding to the outer shape of case protrusion portions 214*a* and 224*a* and case protrusion portions 214*b* and 224*b*. Further, a mating rod 1016*b*1 may be formed on concave portion 1016*b*, which may mate with the mating groove which is formed by case mating grooves 214*b*2 and 224*b*2 of external case 200. When ink cartridge 1 is installed, mating rod 1016*b*1 may be inserted into the mating groove formed by case mating grooves 214*b*2 and 224*b*2. Specifically, not only may the shape of the case protrusion portion formed by case protrusion portions 214*a* and 224*a* different from that of the case protrusion portion formed by case protrusion portions 214*b* and 224*b*, because the shapes of concave portions 1016*a* and 1016*b* of printer 1000 also may be different, when ink cartridge 1 is installed upside-down, mating rod 1016*b*1 becomes an obstacle and ink cartridge 1 cannot be incorrectly installed. Because improper installation of ink cartridge 1 is prevented, it is possible to prevent damage to ink supply portion 120, air intake portion 130, optical sensor 1014, and ink extraction pipe 1015.

Further, within installation portion 1010 and on the edge side of support portion 1012, an engaging member 1017 configured to rotate and to engage mating portions 216*b* and 226*b* may be provided. Engaging member 1017 may fit inside concave portions 216*a* and 226*a* of external case 200. Engaging member 1017 may comprise each of an engaging edge 1017*a* which engages with mating portions 216*b* and 226*b* of external case 200, an axis portion 1017*b* which is connected to engaging edge 1017*a* and which acts as the axis of the rotation of engaging member 1017, and a covering portion 1017*c* which is connected to axis portion 1017*b* and covers the side surface of the external case opposite from the side surface facing installation surface 1013. A convex portion 1017*d* may be formed and may protrude in the circumferential direction from axis portion 1017*b*. Engaging member 1017 may be positioned in an upright posture through the engagement of convex portion 1017*d* with concave portion 1018 which is formed on attachment portion 1010 of printer 1000.

As shown in FIG. 6(*a*), when ink cartridge 1 is installed in printer 1000, ink cartridge 1 may be installed, such that ink supply portion 120 is on the lower side and air intake portion 130 is on the upper side. Specifically, if ink supply portion 120 is not positioned on the lower side, the ink within ink cartridge 1 may not be efficiently used.

Also, when ink cartridge 1 is installed in printer 1000, ink supply portion 120, translucent portion 140, and air intake portion 130 may be positioned in this order from the bottom to the top and, ink supply portion 120, translucent portion 140, and air intake portion 130 may be formed on the same surface. Therefore, because ink supply portion 120, translucent portion 140, and air intake portion 130 may be positioned relatively close to each other on the same surface, it is possible to position optical sensor 1014, ink extraction pipe 1015, and air intake path 1013*b* relatively close to each other on the same surface of printer 1000, such that it is possible to reduce the size of printer 1000.

Installation of ink cartridge 1 may be performed by inserting case protrusion portions 214*a* and 224*a* of the external case 200, such that they contact support portion 1012, and pushing ink cartridge 1, such that first case attachment portions 216 and 226 slides across the top of support portion 1012, e.g., in the direction of the arrow E. As described above, because sloped surfaces 214*a*2 and 224*a*2 may be formed on case protrusions 214*a* and 224*a*, it is possible to smoothly insert ink cartridge 1 onto support portion 1012 using sloped surfaces 214*a*2 and 224*a*2.

As shown in FIG. 6(*b*), when ink cartridge 1 is pressed toward installation portion 1010, locking rod 1011 is pressed by second case attachment portions 217 and 227 and elastically deforms in the direction away from support portion 1012. Moreover, engaging edge portion 1017*a* of engaging member 1017 comes within concave portions 216*a* and 226*a* of external case 200, and then, these come into contact with the mating portions 216*b* and 226*b*. Further, when ink cartridge 1 is inserted, engaging member 1017 rotates upwards.

As shown in FIG. 6(*c*), when ink cartridge 1 is inserted even further from the state shown in FIG. 6(*b*), e.g., when engaging member 1017 is rotated in the arrow F direction by the user, convex portion 1011*a* of locking rod 1011 fits into and engages with locking portions 217*a* and 227*a* of external case 200, which fixes ink cartridge 1. Moreover, convex portion 1017*d* of engaging member 1017 engages with concave portion 1018, thereby fixing ink cartridge 1. Therefore, when ink cartridge 1 is installed in installation portion 1010, it is possible to prevent easy dislodging of ink cartridge 1 due to vibrations caused by printing or the like. In addition, because movement of ink cartridge 1 in the vertical direction may be restricted by locking rod 1011 and support portion 1012, it is possible to prevent damage to optical sensor 1014 and ink extraction pipe 1015 due to insertion of ink cartridge 1 at an angle.

In the above-described embodiments of the present invention, arm portion 41 may be restricted to a predetermined degree of clockwise rotation by contact of the top edge of light blocking portion 42 with the upper surface of translucent portion 140 bounding the top portion of inner space 140*a*, and arm portion 41 may be restricted to a predetermined degree of counterclockwise rotation by contact of the lower edge of light blocking portion 42 with the lower surface of translucent portion 140 bounding the inner space 140*a*. Nevertheless, those of ordinary skill in the art at the time of the invention readily will understand that it is acceptable to have separate means to restrict the rotation of arm portion 41, such as forming a protrusion to prevent excess rotation of arm portion 41, which contacts arm portion 41 when arm portion 41 has made a predetermined degree of clockwise or counterclockwise rotation in ink chamber 111.

Moreover, in the above-described embodiments of the present invention, fulcrum 41*a* is positioned below light blocking portion 42 whenever rotating member 32 is within the range of permissible rotation. Nevertheless, fulcrum 41*a* may be positioned above light blocking portion 42. Fulcrum 41*a* also alternatively may be positioned at a height between the position when light blocking portion 42 is at its highest position and the position when light blocking portion 42 is at its lowest position. Specifically, when light blocking portion 42 is positioned above a predetermined position, fulcrum 41*a* may be positioned below light blocking portion 42, and when light blocking portion 42 is positioned below a predetermined position, fulcrum 41*a* may be positioned above light blocking portion 42.

Moreover, in the above-described embodiments of the present invention, fulcrum 41*a* is formed on arm portion 41 of rotating member 32, and fulcrum 41*a* is supported in a support portion of support member 31. Nevertheless, so long as rotating member 32 is pivotally supported by support member 31, the fulcrum alternatively may be formed on support member 31 and rotating member 32 may have a portion for receiving the fulcrum.

In addition, in the above-described embodiments of the present embodiment, communication path 116 is on the side surface of case 110. Nevertheless, communication path 116 may be formed on the bottom surface of the case which forms the ink chamber.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge, comprising:

an ink chamber comprising a first wall having a first end and a second end opposite the first end, and a second wall which is substantially perpendicular to the first wall and is connected to the second end of the first wall;

a translucent portion positioned at the first wall, wherein the translucent portion is configured to be in fluid communication with the ink chamber, and the translucent portion has an inner space formed therein;

an ink supply portion having an opening formed therethrough, wherein the ink supply portion is positioned at the first wall adjacent to the second end of the first wall, and the translucent portion is positioned between the first end of the first wall and the ink supply portion;

a support member; and a rotatable member connected to the support member, wherein the rotatable member comprises:

a pivot portion formed at a point of connection between the support member and the rotatable member;

a signal blocking portion, wherein the signal blocking portion is disposed within the inner space of the translucent portion; and a float portion disposed within the ink chamber, wherein the float portion is positioned between the signal blocking portion and the pivot portion, and the float portion is configured to move between a first position and a second position based at least on an amount of ink disposed within the ink chamber.

2. The ink cartridge of claim 1, wherein as the ink within the ink chamber is dispensed from the interior of the ink chamber to the exterior of the ink chamber a surface of the ink within the ink chamber moves in a first predetermined direction, and when the float portion moves from the first position to the second position each of the float portion and the signal blocking portion moves about the pivot in a second predetermined direction which is slanted with respect to the first predetermined direction.

3. The ink cartridge of claim 1, wherein the support member is connected to the second wall, and the float portion is positioned closer to the second wall than the signal blocking portion is positioned to the second wall.

4. The ink cartridge of claim 1, further comprising a communication path configured to dispense ink from an interior of the ink chamber to an exterior of the ink chamber via the opening formed through the ink supply portion, wherein the float portion is unaligned with a center line of the communication path when the float portion is in the first position or the second position.

* * * * *